United States Patent [19]

Walter

[11] Patent Number: 4,535,550

[45] Date of Patent: Aug. 20, 1985

[54] PROCESSING OF PARTICULATE MATERIAL

[75] Inventor: Karl H. Walter, Henley South, Australia

[73] Assignee: Adelaide & Wallaroo Fertilizers Ltd., Adelaide, Australia

[21] Appl. No.: 488,539

[22] PCT Filed: Aug. 6, 1982

[86] PCT No.: PCT/AU82/00125

§ 371 Date: Apr. 11, 1983

§ 102(e) Date: Apr. 11, 1983

[87] PCT Pub. No.: WO83/00546

PCT Pub. Date: Feb. 17, 1983

[30] Foreign Application Priority Data

Aug. 10, 1981 [AU] Australia ..... PF0152

[51] Int. Cl.[3] ..... F26B 3/04

[52] U.S. Cl. ..... 34/33; 34/34; 34/134; 34/135; 34/138

[58] Field of Search ..... 34/134, 135, 136, 137, 34/138, 142, 22, 33, 34

[56] References Cited

U.S. PATENT DOCUMENTS

| | | | |
|---|---|---|---|
| 121,915 | 12/1871 | Turner . | |
| 244,148 | 7/1881 | Rowe . | |
| 268,587 | 12/1882 | Witherell et al. . | |
| 506,915 | 10/1893 | De Kinder et al. . | |
| 506,916 | 10/1893 | De Kinder et al. . | |
| 506,917 | 10/1893 | De Kinder et al. . | |
| 535,560 | 3/1895 | Schmiedecke et al. . | |
| 1,284,787 | 11/1918 | Sartakoff . | |
| 2,354,567 | 7/1944 | Adt . | |
| 2,840,922 | 7/1946 | Erisman et al. . | |
| 3,262,218 | 4/1963 | Cymbalisty . | |
| 3,678,598 | 7/1972 | Quiles . | |
| 3,742,613 | 7/1973 | Von Gimborn . | |
| 3,816,070 | 6/1974 | Candor et al. | 34/134 |

FOREIGN PATENT DOCUMENTS

| | | |
|---|---|---|
| 16447 | of 1924 | Australia . |
| 162205 | 9/1953 | Australia . |
| 2125081 | 9/1972 | France . |
| 603654 | 6/1948 | United Kingdom . |
| 1405740 | 9/1975 | United Kingdom . |

*Primary Examiner*—Larry I. Schwartz

*Attorney, Agent, or Firm*—Fleit, Jacobson, Cohn & Price

[57] ABSTRACT

A method and apparatus for processing particulate material charged into a rotary cylindrical vessel (12) having its axis inclined to the horizontal so that one end thereof is raised relative to the other end, and having a respective annular cover plate (16,18) at each end defining a central opening at its end (17,19), the material being charged through the opening (17) at the one end thereof and caused to progress along the vessel (12) and discharge therefrom through the opening (19) at the other end by rotation of the vessel (12). Gas for processing the material is passed into the vessel (12) during rotation of the latter, the gas being supplied from a source thereof, via a supply pipe (34), and discharged within the material (38) in the vessel (12) through port means (44, 48) of at least one discharge conduit (42) which is in communication with the supply pipe (34), extends longitudinally within the vessel (12) and is fixed against rotation with vessel (12); the quantity of material (38) progressing along the vessel (12) being sufficient to cover the at least one conduit (42).

22 Claims, 5 Drawing Figures

PROCESSING OF PARTICULATE MATERIAL

Figure 1:
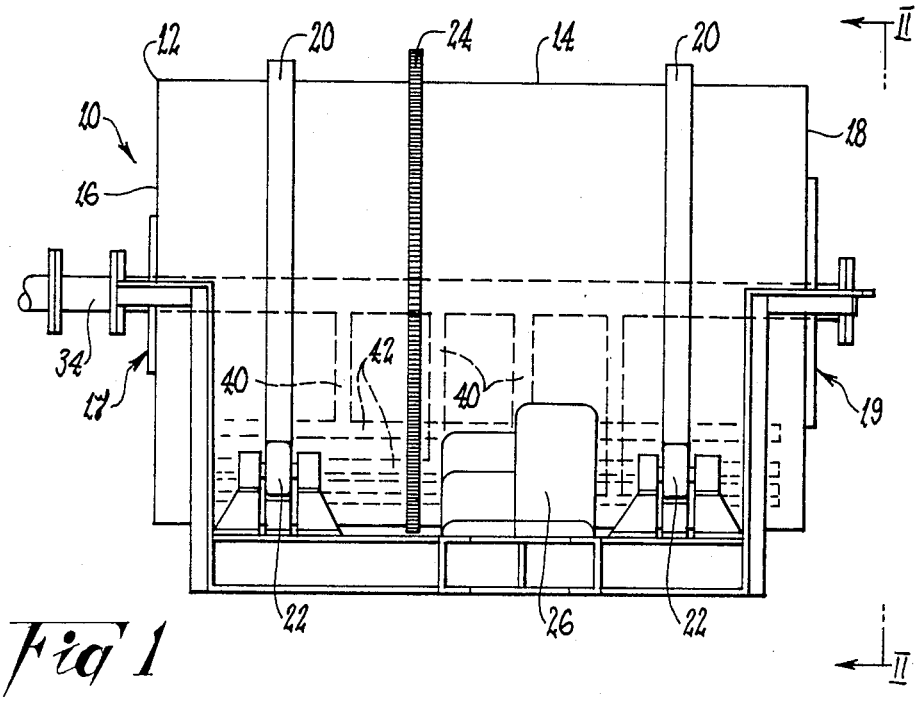

This invention relates to the processing of particulate materials, and to apparatus for this purpose.

The invention has particular application to the drying, heating and cooling of particulate material and the following description is directed to that application.

The drying as well as the heating and cooling of solids are important and very essential features of many commercial processes. Drying of solids can be defined as a process of simultaneous heat and mass transfer, in which the heat essential for the vaporization of the liquid in the solid phase is either obtained by convection or conduction from the drying medium. Cooling and heating are essentially heat transfer processes, although a mass transfer might also occur at the same time. Convection and conduction frequently are the dominant modes of heat transfer in industrial drying, heating and cooling processes in which particulate solids are treated by means of a hot or cold gas stream, as required. This means, therefore, that the better the particulate-gas contact, the better is the heat transfer between the gas and the solid and the greater is the mass and/or heat transfer between the solid and the gas. Thus it is not surprising that fluidized systems, in which the solids are suspended in the gas, give better heat and mass transfers than any other currently known mode of drying or cooling.

Depending upon the mode of heating or cooling a distinction can be drawn between direct and indirect apparatus and processes and, depending upon the gas-solid flow, it is normal to differentiate between concurrent and countercurrent apparatus and processes.

Rotary driers, heaters and coolers, which consist of a rotating cylindrical shell slightly inclined from the horizontal plane, are frequently used in commerce for the large scale drying, heating or cooling of such materials as mineral ores, fertilizers and chemicals. In order to give a greater gas-solid contact in one type of rotary apparatus, the shell can be equipped with flights, which lift the solid particles and allow them to fall through a stream of the gas. Such apparatus, which is normally referred to as a cascading rotary type, is ideally suited for the drying of relatively course particulate matter which does not lend itself to fluidization.

From a purely theoretical point of view, continuous rotary apparatus of the cascading type should have an excellent heat and mass transfer, since the particles fall through the gas which is passing along the shell. However, practical experience is that the heat transfer is poor; the thermal efficiency of such apparatus normally being in the order of 40% to 55%. This poor performance is entirely due to the poor contact between the solid particles and the gas. In this type of apparatus the solid particles form within the shell, curtains of falling solids which offer a greater resistance to the gas flow than the empty space between the falling curtains. The particles thus come into contact with only a very small part of the total gas flowing through the shell. In addition, the small quantity of gas coming into contact with the solids in the curtains very quickly reaches equilibrium conditions in regard to heat as well as mass transfer, which means that the rate of drying, heating or cooling within the curtain will diminish rather rapidly.

In another type of such rotary apparatus, the heating or cooling gas is passed along channels which are created by overlapping louvre plates and enters the bed of particulate solid through the louvres. This type of apparatus gives good heat and mass transfer. However, it cannot be used for sticky products since such products clog the louvres.

In contrast to these continuous rotary driers or coolers, fluid beds with their high degree of interaction between the gas and the particulate solid normally give a thermal efficiency of about 90% to 95%. Thus it is not surprising that fluid bed systems are used in the process industries for the drying, heating and cooling of particulate solids. Unfortunately the practicability of drying, heating or cooling of particulate matter in a fluid bed depends to a very large extent upon the size spectrum of the particulate matter. Mono-disperse systems, that is, those in which all the particles are of the same size, are very easily fluidized. However, more common are poly-disperse systems, in which the particles are not of the same size, and these will only fluidize if the size spectrum is relatively close; that is, the size of the particles does not vary to a very large degree.

In the case of large differences in the particle size, that is, in poly-disperse systems having an open size spectrum, the fine particles will be entrained in the gas and thus removed from the bed. The coarse particles will however not fluidize, but settle out and lead to channelling within the fluid bed; that is, the gas will form vertical channels through the bed which leads to a very poor solid-gas contact. While channelling is an irregularity which is entirely due to the wide or open size spectrum of the particulate solid, another irregularity of fluid beds is mainly due to the surface characteristics of the particulate solid and the design of the fluidizing vessel. This irregularity in the fluidizing characteristics is generally known as slugging and can be described as a condition in which the fluidizing gas forms bubbles, in the dispersed solids. These bubbles coalesce into large bubbles, and can be of a diameter substantially equal to the horizontal dimension of the fluidizing vessel. The gas-solids contact in a slugging bed is extremely poor and leads to low efficiencies in regard to heat and mass transfer.

While correctly operating fluid beds give excellent heat and mass transfers, the pressure drop through the bed is very high, and requires high pressure blowers, which are expensive from a power consumption point of view. In view of these limitations fluid beds have only found limited application in the process industries for the drying, heating and cooling of particulate matter, despite their high thermal efficiency. Thus, while the fluidization of solids gives excellent heat and mass transfer, conventional fluid bed technology suffers from the following disadvantages:

(a) Only particulate matter of uniform size is easily fluidized, while solids having an open size spectrum are not easily fluidizable and very often cannot be fluidized at all.

(b) Small particles or fines in non-uniform or polydisperse solids are easily elutriated from the fluid bed, and have to be collected in expensive gas cleaning equipment.

(c) Coarse particles are difficult to fluidize.

(d) Fluid bed systems have a high hydrodynamic resistance and require large volumes of gas for achieving the state of fluidization and thus are high energy consumers.

As a result of intensive investigations to develop a fluid bed system not suffering from these disadvantages, it now has been found to be possible to develop a fluidizing system by mechanically dispersing the solids in a low pressure gas.

Moreover, it has been found that a rotating cylinder can be used in an arrangement providing mechanical dispersion of the solid particles over a gas distribution system and that this rotary fluidizer can be used for drying, heating or cooling with increased efficiency.

According to the invention, there is provided apparatus for processing of particulate material including a rotary cylindrical vessel having its axis inclined to the horizontal so that one end thereof is raised relative to the other end, a respective annular cover plate at each end of the vessel and defining a central opening at its end, and means for charging processing gas into the vessel through one of said openings; the arrangement being such that, during rotation of the vessel, particulate material charged into the vessel through the opening at the one end thereof progresses along the vessel for discharge through the opening at the other end thereof; the means for charging gas including a supply pipe passing into the vessel through the one opening, and at least one discharge conduit in communication with the supply pipe and extending longitudinally within the vessel; the at least one conduit being fixed against rotation with the vessel in a position for discharge of gas, through port means along the length of the at least one conduit, within a region in the vessel occupied by material progressing along the vessel.

The invention also provides a method for processing particulate material in such apparatus wherein the material is charged into the vessel through the opening at the one end thereof and caused to progress along the vessel and discharge therefrom through the opening at the other end by rotation of the vessel; gas for processing the material being passed into the vessel during rotation of the latter, the gas being supplied from a source thereof, via the supply pipe, and discharged within the material in the vessel through the port means of the at least one conduit; the quantity of material progressing along the vessel being sufficient to cover the at least one conduit.

The at least one conduit may be such as to discharge the gas along substantially the full longitudinal extent of the vessel. For this purpose, the port means may comprise a plurality of outlets spaced longitudinally of the vessel, or at least one outlet of slot form extending longitudinally of the vessel. The port means most conveniently are positioned on the at least one conduit to direct the gas downwardly within the material progressing along the vessel.

Most conveniently, two or more conduits are used. In such case, these may be laterally spaced, circumferentially within the vessel.

The at least one conduit most suitably is spaced from the interior surface of the vessel by a distance that is a relative minor portion of the interior radius of the vessel. Thus, for example, for a vessel of 375 to 500 mm in diameter, the distance by which the or each conduit is spaced from the interior surface of the vessel may range from 50 to 125 mm.

Where the port means comprise a plurality of outlets, the latter may be spaced in a longitudinal row, or they may be in two or more such rows. The latter case is more suitable and the outlets also may be longitudinally offset in adjacent rows. In one convenient arrangement for a vessel of 400 mm radius having three 20 mm internal diameter conduits spaced laterally by 100 mm, it is found that three rows of outlets at 10 mm centers, in such offset array, and 2–4 mm diameter, are particularly suitable.

The apparatus of the invention has some overall similarity to that disclosed in U.S. Pat. No. 3,262,218 to Cymbalisty for treating materials with fluids in a variety of applications. However, a comparison of the apparatus of the invention with the arrangements proposed by Cymbalisty serves to highlight the important differences.

It first is to be noted that the arrangements proposed by Cymbalisty are for applications such as tumbling, mixing and filtering, whereas the present invention principally is for drying, heating or cooling. The arrangements of Cymbalisty require a cylindrical vessel which is closed at each end, and they thus are not suited to a continuous drying operation. Moreover, while the arrangements of Cymbalisty have a plurality of conduits which extend longitudinally within and are spaced circumferentially of the vessel, the conduits are rotatable with the vessel in contrast to the fixed conduits required by the present invention. This latter distinction is of paramount importance, since the arrangement of the present invention is not only considerably less complicated and inexpensive but it also gives rise to significant benefits in the treatment of the particulate material.

The more complicated arrangements of Cymbalisty are readily apparent from the need for a complex valve arrangement between the rotating conduits and pipes supplying fluid to the conduits. Particularly where the particulate material being treated is of an abrasive nature, it is likely to cause wear of the valve components and, where the fluid used is a gas, this then can discharge above the particulate material with reduced efficiency in the treatment of the latter.

However, more importantly, it is found that where the conduits rotate with the vessel as in the arrangements of Cymbalisty, gas-solid contact is significantly less than with fixed conduits. Thus, as with conventional fluidized bed systems, channelling can occur; this being particularly so in the treatment of a wet particulate material with a drying gas. With rotatable conduits, channelling can result from the body of particulate material rotating with the vessel and conduits during a part of each revolution; with the system overall being somewhat akin to a static bed in which neither the vessel or conduits are rotated. Some relative movement between the particulate material and conduits occurs at that level of the vessel at which the particulate material falls away from the side of and back to the bottom of the vessel but this is not sufficient to avoid channelling. However where, as in the present invention, the conduits are fixed, the particulate material is forced past the conduits by rotation of the vessel, and a resultant pronounced tumbling action within the body of the material obviates channelling.

There are further benefits derived with the arrangement of the present invention which are not obtained with the arrangement of Cymbalisty. First, because of tumbling within the body of particulate material, it is found that the gas pressure drop through that material is substantially less than is obtained with rotating conduits by a factor of 10 or more. In addition to reducing power requirements for the supply of the gas, this enhances gas-solid contact, thereby increasing efficiency of treatment and reducing the necessary residence time for material in the vessel. Also, because of that tumbling action and also the low gas pressure possible uniformity of treatment is significantly increased. Additionally, notwithstanding the requirement for an open ended vessel, tumbling action and reduced pressure minimise segregation of particles of different sizes and, principally as a result of the low gas pressure, the level of fines elutriated is extremely low. In the latter regard, the arrangement of the present invention also is in marked contrast to operation of conventional fluidized beds. Moreover, in drying wet particulate material which is prone to fragmentation on heating due to entrapped liquid, it is found that fragmentation can be substantially minimised by use of the present invention, notwithstanding use of relatively hot drying gases. This last mentioned advantage is attributable to the uniformity of heating enabling avoidance of localized hot spots in the body of particulate material as otherwise can occur in pockets of fully dried material.

The gas may pass to the conduits in a variety of ways. Thus the supply pipe may extend axially into the vessel with there being a branch pipe from this for the or each discharge conduit such as at one end of or intermediate of the ends of the vessel. Where there are two or more conduits, only one such branch line may be provided with this extending to one of the conduits and gas passing from the one conduit to the others by at least one connecting line or tube between successive discharge conduits.

Alternatively, the or each conduit may be of crank-form, with end portions thereof on or adjacent the axis of the vessel and a central portion, along which the outlets are spaced, being radially offset so as to be adjacent the interior surface of the vessel. In one convenient arrangement having two or more conduits, one may be of such crank-form and able to receive the gas from the supply pipe, with the or each other conduit simply extending longitudinally in the vessel and receiving gas from the one conduit via a connecting line.

The conduit(s) may be able to be adjusted within the vessel, even though retained against rotation in use of the apparatus. Thus, where a single conduit is used, it may be laterally movable to ensure its positioning within the particulate material for optimum solid-gas contact. Where there are two or more conduits, these may be similarly movable as a whole or to increase or decrease the lateral spacing between successive ones thereof.

The conduits most conveniently are positioned and fixed so as to extend, at least in part, within the lower quadrant of the vessel from which the particulate material is lifted, during rotation of the vessel, prior to the material tumbling down through a central region of the vessel. That is, the conduits are at least in part, most conveniently substantially, within the lower quadrant beyond the vertical central plane of the vessel in the direction of rotation. The conduits thus are positioned within the body of particulate material to be processed and thus are able to release the gas directly into the body of dispersed solid particulates. Due to this positioning the conduits also mechanically interact with, and provide a tumbling action within, the particulate material as it is drawn past the conduits with rotation of the vessel.

A brief consideration of the invention will make apparent that, in the rotary apparatus, the solid particles are dispersed by mechanical action of the conduits and that this enhances the free flow of gas between these dispersed particles. As a result, maximum intimate contact between gas and solids is obtained at a minimum hydrodynamic resistance from the bed, providing an extremely simply arrangement for the drying, heating or cooling of polydisperse particulate material.

The apparatus of the invention is particularly suited to the drying of a wide variety of wet, particulate materials. Illustrative of such materials are potassium chloride, potassium and ammonium sulphates, langbeinite, superphosphate, and N-P and N-P-K fertilizer mixtures, including such mixtures having trace or minor element additions. With some such materials, drying is required after a granulation stage and it is found that due to the tumbling action produced by the conduits the present apparatus is well suited to the drying of freshly agglomerated granules in a granulation circuit. This is a matter of importance since wet, freshly agglomerated granules still possess a certain degree of plasticity and, due to the tumbling action within the body of material achieved with the present invention, compaction is obtained while water is driven off from voids in the granules. As a consequence, the granules have less air entrapped in voids and are considerably denser than those dried in a conventional means such as a rotary drier. Mechanical strength is greatly affected by porosity and granules dried with the present apparatus have considerably greater strength.

When drying many wet particulate materials, it frequently is found that the body of the material will adhere to the vessel wall and be retained thereof during a full revolution. In one highly desirable variant of the invention, this problem can be obviated by lining the full inner circumference of the vessel with a flexible sleeve which is secured to the vessel at intervals around that circumference. The sleeve is secured so that, on rotation of the vessel, portions of the sleeve in the upper half of the vessel can flex under gravity away from the vessel to dislodge any adhering particulate material; the sleeve portions being able to conform again to the vessel as they rotate down below the axis of the vessel. So that such flexing and return of the sleeve portions is not prevented by a reduced pressure between the sleeve and vessel, the latter can be provided around its circumference with apertures permitting the ingress and egress of air.

A variety of materials can be used for the flexible sleeve. Suitable materials are natural and synthetic rubbers, blends of such rubbers, and flexible plastics materials. A choice between such materials should be based on consideration of the particulate materials to be dried and the temperatures at which the sleeve is to be used. However, because of the gas-solid contact possible with the invention, the temperature to which the sleeve is exposed normally need not significantly exceed the boiling point of the liquid to be driven off from the particulate material.

Figure 2:
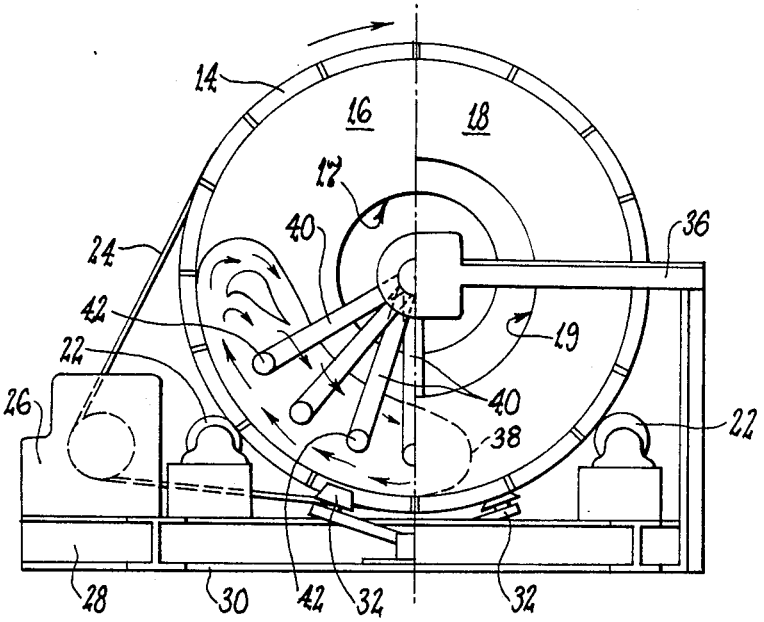
Figure 3:
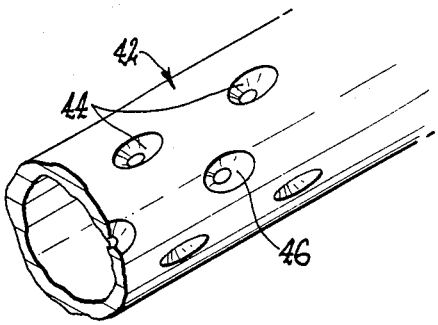
Figure 4:
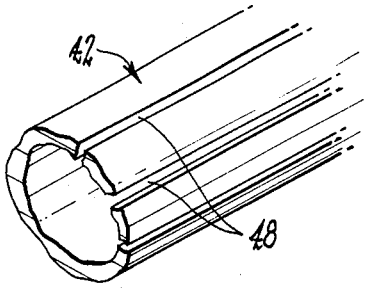
Figure 5:
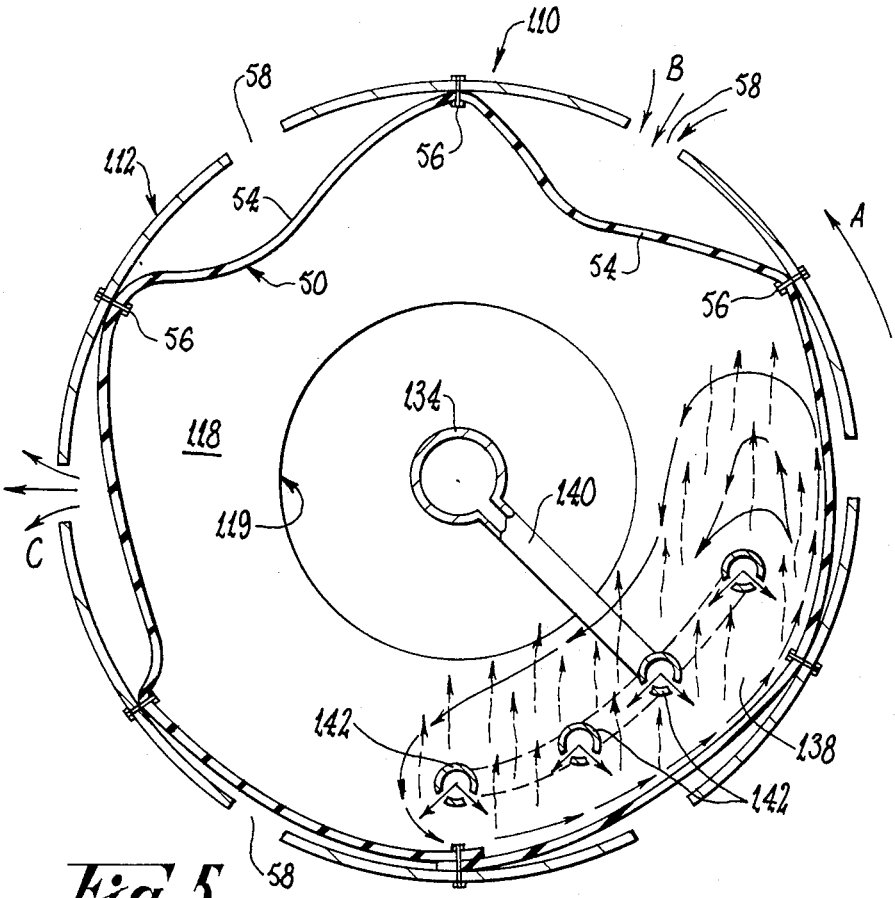

In order that the invention may be more fully understood, description now is directed to the accompanying drawings in which:

FIGS. 1 and 2 show one form of apparatus in side and partial end elevation, respectively; and FIGS. 3 and 4 show on an enlarged scale a portion of respective conduits suitable for use in the arrangement of FIGS. 1 and 2; and FIG. 5 shows in a schematic sectional view, another form of apparatus.

In FIGS. 1 and 2, the rotary fluidizer apparatus 10 consists of a horizontal drum 12 as in a cascading rotary drier, which has a cylindrical shell 14 and annular end cover plates 16, 18. Drum 12 is supported in a conventional manner, by two riding rings or tyres 20 each running on a pair of trunnion wheel assemblies 22, so as to be inclined slightly downwardly from its inlet 17 through end 16 to its outlet 19 through end 18. The drum is rotated by means of a conventional drive system which incorporates a circumferential chain 24 and drive motor 26. The drum, trunnion assemblies, drive motor and support bracket 28 for motor 26 are all mounted on a common base 30. Thrust roller assemblies 32 are used to prevent lateral movement of the drum along the axis of rotation.

Apparatus 10 includes a supply pipe 34, supported at both ends of drum 12 by means of a support brackets 36 attached to base 30. Pipe 34 passes axially through annular plates 16, 18 which are used to retain the tumbling bed 38 of solid particles being dried, heated or cooled in the apparatus. A number of radially extending pipes 40 pass from the supply pipe 34 and supply the processing gas to conduits 42 for distribution within the tumbling bed 38 of solid particles.

The portion of a conduit 42 shown in FIG. 3 has along its length three rows of outlet ports or apertures 44. The apertures of successive rows are off-set and, to increase spreading of fluid passing therethrough, each outlet has a conically flared outer end 46. The portion of conduit 42 shown in FIG. 4 has three longitudinally extending outlet slots 48. While slots 48 are shown as parallel sided and continuous, their sides may diverge outwardly and/or they may be discontinuous.

In the arrangement of FIGS. 1 and 2, there are four conduits 42. One of these is located below the axis of drum 12, with the others being laterally spaced from the center line in the direction of rotation. Conduits 42 thus are in the lower quadrant of drum 12 in which the bulk of the material of bed 38 is located immediately prior to being lifted to tumble down in drum 12. In view of this location, and the relatively close positioning of the conduits in relation to the inner surface of the drum, the conduits extend within bed 38 of particles prior to the particles being lifted to tumble down in the drum. As a consequence, conduits 42 provide a tumbling or mixing action within the bed 38 and enhance a gas-solid contact. Conduits 42 may be laterally movable so as to vary their position within bed 38, either as a whole or relative to each other, so as to enhance such contact.

Outlet apertures 44 or slots 48 most conveniently are arranged so that gas released therefrom passes downwardly from conduits 42, such as radially or in a direction inclined to the radial in the direction or rotation. As a consequence, the fluid remains in contact longer with the material of bed 38 before being lifted beyond the conduits 42, above the horizontal.

FIG. 5 schematically shows a transverse sectional view of a rotary fluidizer 110 which, in detail, may be similar to the apparatus of FIGS. 1 and 2; and corresponding parts have the same reference numeral plus 100. The cylinder or drum 112 of apparatus 110 has a lining 50 formed of panels 54 which extend along the full axial extent of the drum. Adjacent edges of successive panels 54 are fixed longitudinally within drum 112, as shown at 56 and are formed of flexible sheeting. Thus, as the drum 112 is rotated in the direction of arrow A, panels 54 are able to collapse downwardly under gravity, between their edges at 56, as they approach the zenith; thereby dislodging any of the particulate material from bed 138 which adheres thereto. Suitable apertures 58 in drum 112 enable the ingress of air (arrows B) between the inner surface of drum 112 and panels 54 to facilitate such collapse, and the egress of air (arrows C) as panels 54 collapse back against that surface on rotation toward the nadir of the drum.

Panels 54 allow treatment of sticky materials which otherwise would pose a problem in regard to build up on drum 112. They can be of any suitable flexible sheeting. Most conveniently, the width of each sheet is slightly greater than the circumferential spacing between their fixtures at 56 so that their collapsing away from drum 112 is not prevented by a reduced pressure therebetween.

Rather than being of separate panels 54, the lining 50 can be of a circumferentially continuous sleeve. In either case, the lining should be of a material able to withstand the operating temperature to prevail in the drum adjacent the lining. However, the temperaure adjacent the lining can, in a drying operation, be substantially less than the temperature of drying gas supplied to the apparatus. Thus, in drying particulate material by evaporation of water, the drying gas can be at a temperature as high as 600°–800° C. but, due to the good gas-solid contact produced by the discharge conduits, temperatures adjacent the lining are not likely to significantly exceed 100° C. if drying is continued down to a normally acceptable level of about 0.5% water content for the particulate material at the discharge end of the apparatus.

Best performance in regard to the tumbling action of the bed is obtained with the apparatus of the invention when the drum is rotating at a speed in the range 20% to 80% of the critical speed. The "critical speed" is defined as the speed at which the centrifugal force on a particle in contact with the drum equals, in the zenith of rotation, the gravitational forces on the said particle; that is, when $g=rw^2$, g being the acceleration due to gravity (9.81 m/sec/sec), r being the radius of the drum in meters and w being the angular velocity in radians per second.

The critical speed $N_{cs}$ then is given by:

$$N_{cs} = \frac{42.3}{\sqrt{2r}} \text{ revolutions per minute}$$

Examples of operation with apparatus as described now are detailed. In the Examples, mean surface area of bed is defined as the area in the horizontal plane of the drum which can be laid on the perpendicular chord to the center line and tangentially to the inner radius of the end plate of the outlet end, while depth of bed is defined as the difference between the inner and outer radii of that end plate. In additiion, the specific water evaporation rate is defined as the quantity of water evaporated from the solid per unit volume of the drum per unit time, and the mean fluidizing velocity is the volumetric flow rate of gas per unit time divided by the mean surface area of the bed.

The Examples of the performance of the invention were based on two pilot plant apparatuses as detailed in Table I.

TABLE I

TYPICAL DIMENSIONS OF ROTARY FLUIDIZERS

| | | UNIT NO. 1 | UNIT NO. 2 |
|---|---|---|---|
| DIAMETER OF ROTARY DRUM $D_R$ | m | 0.568 | 1.800 |
| LENGTH OF ROTARY DRUM $L_D$ | m | 0.840 | 2.620 |
| TOTAL VOLUME OF ROTARY DRUM ($V_D$) | $m^3$ | 0.213 | 6.663 |

TABLE I-continued

| TYPICAL DIMENSIONS OF ROTARY FLUIDIZERS | | UNIT NO. 1 | UNIT NO. 2 |
|---|---|---|---|
| CRITICAL SPEED OF DRUM ($N_{cs}$) | r.p.m. | 56.15 | 31.58 |
| SPEED OF ROTATION: | | | |
| Actual | r.p.m. | 16.5 | 7 |
| As % of Critical Speed ($N_{cs}$) | % of $N_{cs}$ | 29.5 | 22.2 |
| DEPTH OF BED $h_B$ | m | 0.134 | 0.43 |
| MEAN SURFACE AREA OF BED $A_B$ | $m^2$ | 0.405 | 4.022 |
| PRESSURE DROP THROUGH DISTRIBUTION SYSTEM AND BED | mm W.G. | 306 | 1065 |

EXAMPLE 1

The performance of the 0.568 m diameter rotary fluidizing unit was tested on the drying of phosphate rock ex Florida having the particle size distribution shown in Table II.

TABLE II

| SCREEN APERTURE mm | % CUMULATIVE RETAINED SINGLE SUPERPHOSPHATE | ROCK PHOSPHATE |
|---|---|---|
| +12.5 | 3 | 2 |
| +4.75 | 6 | 7 |
| +3.35 | 25 | 28 |
| +2.00 | 51 | 39 |
| +1.00 | 90 | 73 |
| +0.589 | 96 | 81 |
| +0.208 | 98 | 92 |
| +0.150 | 99 | 99 |

The results of these tests are summarised in Table III.

TABLE III

| TEST RUN | NO. 1 | NO. 2 | NO. 3 | NO. 4 | NO. 5 | NO. 6 |
|---|---|---|---|---|---|---|
| FLUID TEMP. INLET °C. | 106 | 241 | 280 | 305 | 390 | 540 |
| BED TEMP. °C. | 37 | 53 | 103 | 64 | 70 | 101 |
| FLUID FLOW a . $m^3$/h | 230 | 281 | 389 | 408 | 477 | 444 |
| MEAN FLUIDIZATION VELOCITY a . m/min | 9.5 | 11.6 | 16.0 | 16.8 | 19.6 | 18.3 |
| FEED RATE kg/h | 331.2 | 1497 | 258.1 | 438.3 | 669.9 | 638.4 |
| FEED MOISTURE % | 10.3 | 10.5 | 11.4 | 11.7 | 11.0 | 11.7 |
| PRODUCT MOISTURE % | 9.1 | 8.1 | 1.0 | 4.2 | 4.3 | 3.4 |
| WATER EVAPORATED kg/h | 4.3 | 39.0 | 27.1 | 34.3 | 46.9 | 63.4 |
| SPECIFIC WATER EVAPORATION RATE kg/$m^3$/h | 20.2 | 183 | 127 | 161 | 220 | 298 |
| EMPTY VESSEL VELOCITY (a) m/min | 15.2 | 18.5 | 25.6 | 26.9 | 31.4 | 29.2 |
| THERMAL EFFICIENCY % | 70 | 85 | 82 | 91 | 90 | 94 |

EXAMPLE 2

The performance of the 0.568 m diameter rotary fluidizer was tested on the drying, as well as the cooling of freshly excavated and granulated superphosphate having the particle size distribution shown in Table II. The results of these tests are summarized in Table IV.

TABLE IV

| Type of Test | Drying | Cooling |
|---|---|---|
| FLUID TEMP. IN °C. | 400 | 17 |
| FLUID TEMP. OUT °C. | 98 | 35 |
| FLUID FLOW (a)$m^3$/h | 185 | 49.5 |
| MEAN FLUIDIZATION VELOCITY (a)m/min | 7.6 | 2.0 |
| FEED RATE kg/h | 365 | 378 |
| FEED TEMP. IN °C. | 49 | 51 |
| PRODUCT TEMP. OUT °C. | 96 | 30 |

TABLE IV-continued

| Type of Test | Drying | Cooling |
|---|---|---|
| FEED MOISTURE % | 10 | — |
| PRODUCT MOISTURE % | 6 | — |
| WATER EVAPORATED kg/h | 15.5 | — |
| SPECIFIC WATER EVAPORATION RATE kg/$m^3$/h | 72.9 | — |
| EMPTY VESSEL VELOCITY (a)m/min | 12.2 | 3.26 |

In pilot unit No. 2, it was further shown that the apparatus of the invention provides an extremely efficient means of drying and cooling of fertilizers. The tests in the following Example are illustrative.

EXAMPLE 3

In these tests two 1.8 m in diameter rotary fluidizer units were arranged in series. The first unit was operated as a drier for single superphosphate and the second unit was operated as a cooler; the dried material discharged from the first unit being charged to the second unit. Extensive tests yielded the mean operating conditions and results, set out in Table V.

TABLE V

| TYPE OF TEST | DRYING | COOLING |
|---|---|---|
| FLUID TEMP. IN °C. | 400 | 28 |
| FLUID TEMP. OUT °C. | 80 | 50 |
| FLUID FLOW (a)$m^3$/h | 2725 | 1219 |
| MEAN FLUIDIZATION VELOCITY (a)m/min | 11.3 | 5.05 |
| FEED RATE t/h | 32 | 31.52 |
| FEED TEMP. IN °C. | 47 | 75 |
| PRODUCT TEMP. OUT °C. | 75 | 45 |
| FEED MOISTURE IN % | 10 | 8.9 |
| PRODUCT MOISTURE % | 8.9 | 8.4 |
| WATER EVAPORATED kg/h | 386.4 | 172.1 |
| SPECIFIC WATER EVAPORATION RATE kg/$m^3$/h | 57.9 | 25.83 |
| EMPTY VESSEL VELOCITY (a)m/min | 17.9 | 8.0 |

EXAMPLE 4

The general procedure of the previous Example 3 was repeated except that, instead of single superphosphate, wet granules of the following materials were used in successive tests as feeds to the units: potassium chloride, potassium sulphate, ammonium sulphate, langbeinite, (a potassium-magnesium sulphate), N-P fertilizer mixtures, N-P-K fertilizer mixtures as well as fertilizer-trace (minor) element mixtures.

The specific water evaporation rate and all other parameters of performance were of the same order as those established in the previous examples.

The arrangement and method provided by the invention are well suited to the drying, heating and cooling of particulate material. Thus, it is found that in drying fertilizer material by drying air supplied at a given temperature and rate to a given feed rate of the fertilizer, drying to a required degree can be effected in apparatus according to the invention in approximately one-half the time required for conventional use of a drier of the same diameter but approximately three times the length. It will be appreciated that not only is the requirement for heated air considerably reduced, but also that residence time in the drum is similarly reduced. Also the dust losses from the bed are negligible in comparison with conventional rotary driers or fluid bed driers and problems in separating and recycling of fines thus are substantially obviated.

It is understood that various modifications and/or alterations may be made without departing from the ambit of the invention as outlined above. Thus, while the conduits for the discharge of treating gas into the particulate material are shown as being of circular section, other sections are possible. Thus, they for example may be of lenticular section so as to enhance lifting and tumbling of the particulate material.

I claim:

1. Apparatus for processing of particulate material, said apparatus comprising: a vessel including a cylindrical shell having its axis inclined to the horizontal so that one end is raised relative to the other end, a respective end plate at each end of the shell, and means for charging processing gas into the shell from a source thereof; said vessel being open at said ends to enable particulate material solids to be charged continuously through said one end thereof into the shell and to enable said solids to be discharged continuously from the other end thereof; said shell being rotatable on said axis so that a tumbling bed of particulate solids is formed and retained during rotation substantially within a second one, in the direction of said rotation, of first and second lower quadrants of the shell; said gas charging means comprising a gas supply pipe passing into the vessel through an end thereof, and at least one discharge conduit in communication with the gas supply pipe and extending within and along substantially the full length of the shell; the at least one gas discharge conduit being fixed, within said second quadrant, against rotation with the shell, and having port means comprising a plurality of outlets spaced along its length; the at least one conduit being fixed within said second quadrant at a location such that, during rotation of the shell, the at least one conduit is within said tumbling bed and mechanically disperses particulate material of the bed by engagement therewith, and at a location such that the at least one conduit is spaced from, and discharges said gas outwardly toward, said shell to cause the gas to be discharged within said bed and to effect contact between said gas and particulate material of the bed at substantially below the elutriation velocities for particles of said material.

2. Apparatus according to claim 1, wherein there is a plurality of said conduits in laterally spaced relation circumferentially of said vessel.

3. Apparatus according to claim 2, wherein the lateral spacing between said conduits is adjustable.

4. Apparatus according to claim 2, wherein said supply pipe extends longitudinally through said vessel and each of said conduits is in direct communication with said supply pipe by means of a respective radially extending pipe.

5. Apparatus according to claim 2, wherein said conduits are in communication by means of at least one circumferentially extending pipe, with one of said conduits being in direct communication with said supply pipe by means of a radially extending pipe, such that gas received by the one conduit is able to pass to the other conduits through said circumferentially extending pipe.

6. Apparatus according to claim 1, wherein said vessel has a flexible liner extending circumferentially therein, the liner being secured longitudinally of the vessel at circumferentially spaced locations such that sections of the liner can collapse away from, and return to contact with, the vessel as the sections approach the zenith and nadir, respectively, on rotation of the vessel.

7. Apparatus according to claim 6, wherein said liner is in the form of a sleeve and said vessel has at least one aperture adjacent each section to permit the ingress and egress, respectively, of atmospheric air during said collapse from and return to contact with the vessel.

8. Apparatus according to claim 6, wherein each section of the liner comprises a respective panel and said vessel has at least one aperture adjacent each section to permit the ingress and egress, respectively, of atmospheric air during said collapse from and return to contact with the vessel.

9. Apparatus according to claim 2, wherein said vessel has a flexible liner extending circumferentially therein, the liner being secured longitudinally of the vessel at circumferentially spaced locations such that sections of the liner can collapse away from, and return to contact with, the vessel as the sections approach the zenith and nadir, respectively, on rotation of the vessel.

10. Apparatus according to claim 3, wherein said vessel has a flexible liner extending circumferentially therein, the liner being secured longitudinally of the vessel at circumferentially spaced locations such that sections of the liner can collapse away from, and return to contact with, the vessel as the sections approach the zenith and nadir, respectively, on rotation of the vessel.

11. Apparatus according to claim 4, wherein said vessel has a flexible liner extending circumferentially therein, the liner being secured longitudinally of the vessel at circumferentially spaced locations such that sections of the liner can collapse away from, and return to contact with, the vessel as the sections approach the zenith and nadir, respectively, on rotation of the vessel.

12. Apparatus according to claim 5, wherein said vessel has a flexible liner extending circumferentially therein, the liner being secured longitudinally of the vessel at circumferentially spaced locations such that sections of the liner can collapse away from, and return to contact with, the vessel as the sections approach the zenith and nadir, respectively, on rotation of the vessel.

13. A method for processing particulate material, said method comprising the steps of:

(a) charging particulate material feed to one end of a vessel comprising a rotating shell and a respective end plate at each end of the shell, to form a tumbling bed of particulate material which bed is substantially retained in a second one, in the direction of rotation of the shell of the lower quadrants of the vessel, said shell having its axis inclined to the horizontal so that said one end is raised relative to the other end;

(b) simultaneously with rotation of said shell, charging treatment gas from a source thereof to a supply pipe passing into the vessel from an end thereof, and from the supply pipe to at least one discharge conduit extending within and along substantially the full length of said shell, said at least one conduit having port means comprising a plurality of gas outlets spaced along its length and being fixed against rotation with said shell at a location, within said tumbling bed and spaced from the shell, such that said at least one conduit mechanically disperses particulate material of the bed by engagement therewith and discharges said gas within said bed and toward the shell to effect contact between said gas and particulate material, said contact being substantially below elutriation velocities for particles of said material; and (c) simultaneously with charging said treatment gas, discharging particulate material from the bed at the other end of the vessel.

14. A method according to claim 13, wherein said vessel is rotated at from 20% to 80% of its critical speed.

15. A method according to claim 13 as applied to the drying of wet particulate material, said vessel having a liner secured longitudinally in the vessel at circumferentially spaced locations such that sections of the liner can collapse away from, and return to contact with, the vessel as the sections approach the zenith and nadir, respectively, on rotation of the vessel wherein during rotation of the vessel any of said material adhering to the liner is displaced therefrom and falls to the base of the vessel due to said collapse of successive sections away from the vessel.

16. A method according to claim 15, wherein said gas is passed into said vessel at a higher temperature than can be withstood by the material of said liner, said material being dried only to a degree such that the liner is not exposed to a temperature substantially in excess of the vaporization temperature for liquid being dried from the particulate material.

17. A method according to claim 13 as applied to the drying of particulate material, wherein said vessel has a liner therein and said gas is passed into said vessel at a higher temperature than can be withstood by the material of said liner, said material being dried only to a degree such that the liner is not exposed to a temperature substantially in excess of the vaporization temperature for liquid being dried from the particulate material.

18. A method according to claim 13, wherein there is a plurality of said conduits, with said gas being caused to discharge, within said material, from each of said conduits.

19. A method according to claim 14, wherein there is a plurality of said conduits, with said gas being caused to discharge, within said material, from each of said conduits.

20. A method according to claim 15, wherein there is a plurality of said conduits, with said gas being caused to discharge, within said material, from each of said conduits.

21. A method according to claim 16, wherein there is a plurality of said conduits, with said gas being caused to discharge, within said material, from each of said conduits.

22. A method according to claim 17, wherein there is a plurality of said conduits, with said gas being caused to discharge, within said material, from each of said conduits.

* * * * *